US008729831B2

(12) United States Patent
Bungo

(10) Patent No.: US 8,729,831 B2
(45) Date of Patent: May 20, 2014

(54) LIGHT SOURCE APPARATUS

(75) Inventor: Hajime Bungo, Muko (JP)

(73) Assignee: Shimadzu Corporation, Kyoto (JP)

( * ) Notice: Subject to any disclaimer, the term of this patent is extended or adjusted under 35 U.S.C. 154(b) by 94 days.

(21) Appl. No.: 13/572,843

(22) Filed: Aug. 13, 2012

(65) Prior Publication Data

US 2013/0049639 A1 Feb. 28, 2013

(30) Foreign Application Priority Data

Aug. 29, 2011 (JP) ..... 2011-185540

(51) Int. Cl.
*H05B 41/36* (2006.01)
*H01J 61/68* (2006.01)

(52) U.S. Cl.
USPC ..... 315/307; 315/49; 315/94; 315/107

(58) Field of Classification Search
USPC ..... 315/307, 94, 49, 50, 107, 71, 326, 240
See application file for complete search history.

(56) References Cited

U.S. PATENT DOCUMENTS 5,047,689 A * 9/1991 Kawai et al. ..... 315/94
2008/0048586 A1* 2/2008 Hasegawa et al. ..... 315/307

FOREIGN PATENT DOCUMENTS

JP 09-210780 A 8/1997

* cited by examiner

*Primary Examiner* — Daniel D Chang
(74) *Attorney, Agent, or Firm* — Westerman, Hattori, Daniels & Adrian, LLP

(57) ABSTRACT

A constant-current power source unit has a variable power source which can adjust an output voltage. To detect a voltage applied to the gas discharge tube, a voltage detection unit is provided. A power source controlling unit configured to control the voltage by adding a predetermined voltage to the voltage taken in from the voltage detection unit after the electric discharge is started in the gas discharge tube.

6 Claims, 4 Drawing Sheets

LIGHT SOURCE APPARATUS

BACKGROUND OF THE INVENTION

1. Field of the Invention

The present invention relates to a light source apparatus which has a gas discharge tube, such as a deuterium lamp, for use in optical measuring equipment, such as a spectrophotometer, used in a liquid chromatograph detector.

2. Description of the Related Art

A light source apparatus having a gas discharge tube, such as a deuterium lamp, has a trigger power source unit which applies a high voltage between the electrodes of the gas discharge tube for starting electric discharge, and a constant-current power source unit which applies a constant voltage to the gas discharge tube to maintain the electric discharge of the gas discharge tube and constant-current controls an electric current flowing between the electrodes of the gas discharge tube to maintain luminous intensity constant (for instance, see Japanese Unexamined Patent Publication No. 9-210780).

An example of a conventional typical gas discharge tube driving circuit is shown. FIG. 4 is a circuit diagram schematically showing an example of the driving circuit of a deuterium lamp which is a kind of gas discharge tube.

The driving circuit of a deuterium lamp 102 has a trigger power source unit 103 which applies a high voltage for starting electric discharge in the deuterium lamp 102, a heater power source unit 104 which heats a cathode of the deuterium lamp 102, and a constant-current power source unit 105 which applies a constant discharge maintaining voltage to the deuterium lamp 102.

The trigger power source unit 103 has a direct current power source 106 and a charging circuit including a series circuit of a capacitor 108 and a resistor 110, and switches and connects the charging circuit to either the direct current power source 106 or the deuterium lamp 102 by a switch 112.

To apply the constant voltage for maintaining electric discharge after the electric discharge of the deuterium lamp 102, the constant-current power source unit 105 has a constant-current power source 114, a compensation resistor 117, and a diode 118. To prevent the inflow of the high voltage for starting electric discharge from the trigger power source unit 103, the diode 118 is connected so that the cathode thereof is on the deuterium lamp 102 side. The voltage of the constant-current power source unit 105 is lower than the voltage applied from the trigger power source unit 103.

FIG. 4 shows a state of charging the charging circuit, and the switch 112 is connected to the direct current power source 106 side indicated as <OFF>. When electric discharge is started, the switch is connected to the deuterium lamp 102 side indicated as <ON>, the high voltage is applied to the deuterium lamp 102 by an electric charge accumulated in the capacitor 108, and electric discharge occurs between the electrodes of the deuterium lamp 102. After electric discharge is started in the deuterium lamp 102, the switch 112 is switched to the direct current power source 106 side indicated as <OFF> again, and then, only the constant voltage of the constant-current power source unit 105 is continuously applied to the deuterium lamp 102, thereby maintaining the electric discharge in the deuterium lamp 102.

In the driving circuit of the gas discharge tube, the constant-current power source unit 105 typically constant-current controls the deuterium lamp 102 so that the electric current value is 300 mA at a set voltage of about 150 V. On the other hand, the discharge maintaining voltage for maintaining lighting in the deuterium lamp 102 after the deuterium lamp 102 is lit is about 80±10 V regardless of an individual difference. Therefore, when the set voltage of the constant-current power source unit 105 is set to 150 V, a power loss of about 18 to 24 W obtained by multiplying 150−(80±10)=60 to 80 V by 300 mA occurs in the constant-current power source unit 105 after the deuterium lamp 102 is lit. The power loss appears as heat generation. Conventionally, the heat generation amount is heat-released to increase the temperature in the apparatus, thereby causing drift of a detection signal of a detector.

In addition, for some kinds of deuterium lamps, a voltage of e.g., about 200 V is required to be applied from the constant-current power source unit immediately after the start of lighting, but the discharge maintaining voltage thereafter requires only about 90±20 V. In this case, when electric discharge is maintained at 200 V, the power loss that is the heat generation amount from the light source unit becomes larger, with the result that the stability of analyzing accuracy of the apparatus and the drift ability are deteriorated.

To improve the above problems, there is also an apparatus which lowers the generated voltage of the constant-current power source unit to the voltage necessary for maintaining electric discharge after the deuterium lamp is lit. However, as already described, even when the discharge maintaining voltage of the deuterium lamp is e.g., 90 V in the standards, there is actually an individual difference between 70 and 110 V. Therefore, as the voltage necessary for maintaining electric discharge after the deuterium lamp is lit, 110 V which is the highest is required to be considered. Typically, from the viewpoint of reliability, 130 V obtained by adding an allowance of e.g., 20 V to 110 V is set as the discharge maintaining voltage value. Therefore, when the deuterium lamp in which the actual discharge maintaining voltage is lower than 110 V is used, the power loss becomes larger, with the result that the heat release amount from the light source unit is also increased.

SUMMARY OF THE INVENTION

An object of the present invention is to provide a light source apparatus providing a gas discharge tube driving circuit which has a small heat release amount by reducing the difference between the discharge maintaining voltage of a gas discharge tube, such as a deuterium lamp, and a voltage which is actually applied to the gas discharge tube.

The present invention provides a light source apparatus which has a gas discharge tube, a trigger power source unit, a trigger switch, a constant-current power source unit, a voltage detection unit, and a power source controlling unit. The trigger power source unit is configured to apply a predetermined voltage so that the applied voltage to the gas discharge tube reaches a voltage at which electric discharge is started in the gas discharge tube when the gas discharge tube is lit. The trigger switch switches on and off the application of the voltage from the trigger power source unit to the gas discharge tube. The constant-current power source unit is connected to the gas discharge tube. The constant-current power source unit is configured to apply a voltage to the gas discharge tube and to perform the constant-current control of an electric current flowing in the gas discharge tube, and the constant-current power source unit has a variable power source which is configured to adjust the voltage applied to the gas discharge tube. The voltage detection unit is configured to detect the voltage applied to the gas discharge tube. The power source controlling unit is configured to control the constant-current power source unit so that the voltage applied to the gas discharge tube has a discharge maintaining voltage value which maintains the electric discharge of the gas discharge tube after the electric discharge is started in the gas discharge tube. The power source controlling unit has source voltage controlling means for setting, as an operating voltage, a voltage obtained by adding a predetermined voltage to the voltage taken in from the voltage detection unit when the output voltage of the variable power source is a predetermined start voltage and for feedback-controlling the variable power source so that after the operating voltage is set, the voltage taken in from the voltage detection unit is the operating voltage.

The light source apparatus of the present invention has the voltage detection unit which detects the voltage applied to the gas discharge tube, wherein the constant-current power source unit has the variable power source which can adjust the voltage applied to the gas discharge tube, wherein the power source controlling unit has source voltage controlling means which sets, as an operating voltage, a voltage obtained by adding a predetermined voltage to the voltage taken in from the voltage detection unit when the output voltage of the variable power source is a predetermined start voltage and feedback-controls the variable power source so that after the operating voltage is set, the voltage taken in from the voltage detection unit is the operating voltage, whereby the output voltage from the constant-current power source unit after electric discharge is started in the discharge tube can be the operating voltage set based on the voltage taken in from the voltage detection unit, thereby enabling the power loss to be reduced. Thereby, the heat generation from the light source can be prevented to stabilize the temperature in an analyzer using the power source apparatus, and the drift of the detection signal can be prevented.

DETAILED DESCRIPTION OF THE INVENTION

In a preferred embodiment of a light source apparatus of the present invention, a constant-current power source unit has a switching circuit which selects one of a plurality of electric current values flown to a gas discharge tube, and a power source controlling unit has a mode selection unit which switches the switching circuit. Thereby, the electric current flowing in the gas discharge tube can be made smaller to reduce the power consumption, so that the power loss can be reduced.

Figure 1:
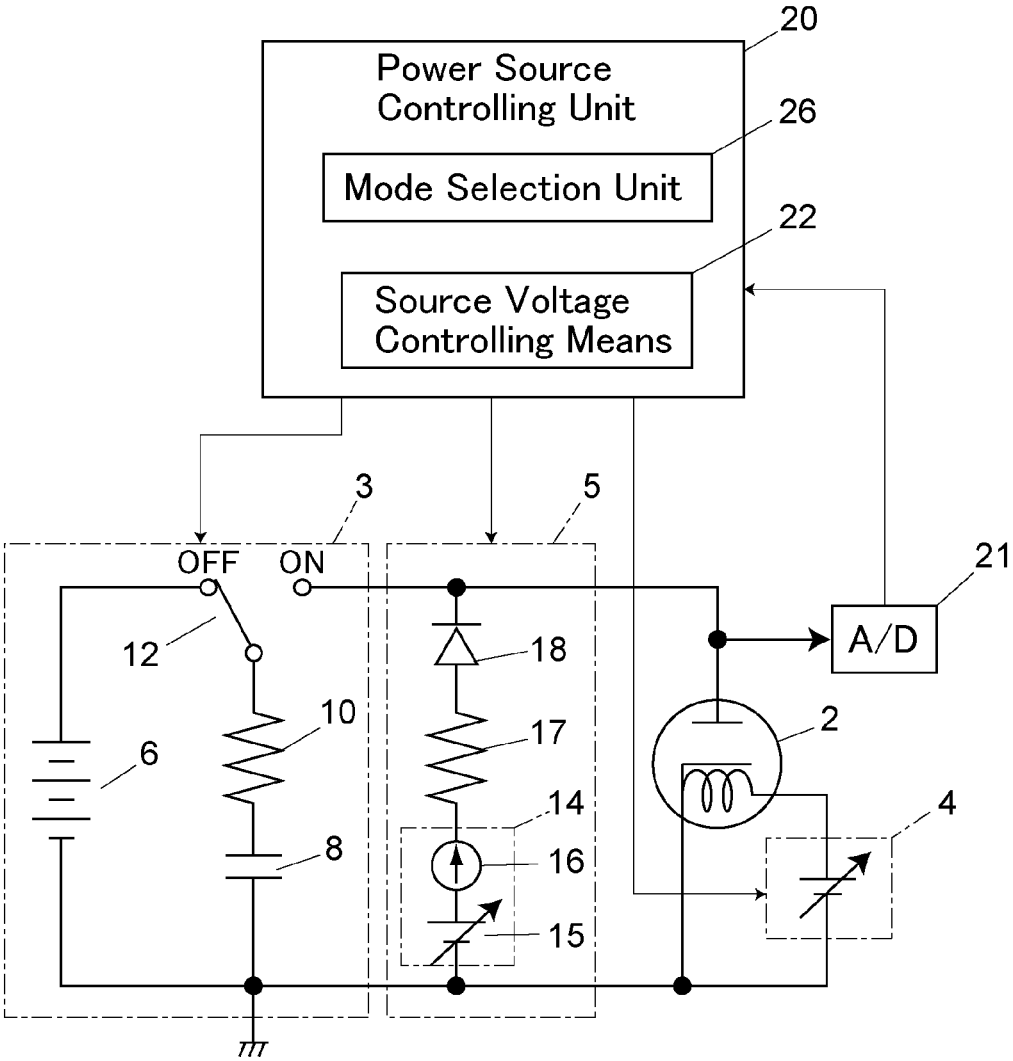
FIG. 1 is a circuit diagram schematically showing an embodiment of a light source apparatus.

Hereinafter, an embodiment of the light source apparatus having a deuterium lamp which is a kind of gas discharge tube will be described. FIG. 1 is a circuit block diagram schematically showing the light source apparatus having the deuterium lamp.

As a power source unit which applies a voltage to a deuterium lamp 2, a trigger power source unit 3 and a constant-current power source unit 5 are connected to an anode of the deuterium lamp 2. To apply the voltage to a heater which heats the cathode of the deuterium lamp 2, a heater power source 4 is connected to the heater.

The trigger power source unit 3 has a direct current power source 6 and a charging circuit including a series circuit of a capacitor 8 and a resistor 10, and switches and connects the charging circuit to either the direct current power source 6 or the deuterium lamp 2 by a switch 12. In FIG. 1, the trigger switch 12 is connected to the <OFF> side which connects the charging circuit to the direct current power source 6 side. In this state, the charging circuit is connected to the direct current power source 6, and an electric charge is accumulated in the capacitor 8. On the other hand, when the trigger switch 12 is switched to the <ON> side, the capacitor 8 of the charging circuit is connected to the deuterium lamp 2 side. When the deuterium lamp 2 is lit, the trigger switch 12 is switched to the <ON> side, so that the charged voltage of the capacitor 8 is applied to the deuterium lamp 2.

The constant-current power source unit 5 is connected to the deuterium lamp 2 in parallel with the trigger power source unit 3. The constant-current power source unit 5 applies a voltage to the deuterium lamp 2 when and after the deuterium lamp 2 is lit. The constant-current power source unit 5 is the series circuit of a constant-current power source circuit 14 which can regulate the applied voltage to the deuterium lamp 2 and can change a supplied electric current at two stages, a compensation resistor 17, and a diode 18. The constant-current power source circuit 14 includes a variable power source 15 which can regulate the applied voltage and a constant-current circuit 16 which can change a supplied electric current at two stages, and a specific example thereof will be described later with reference to FIG. 2.

Figure 2:
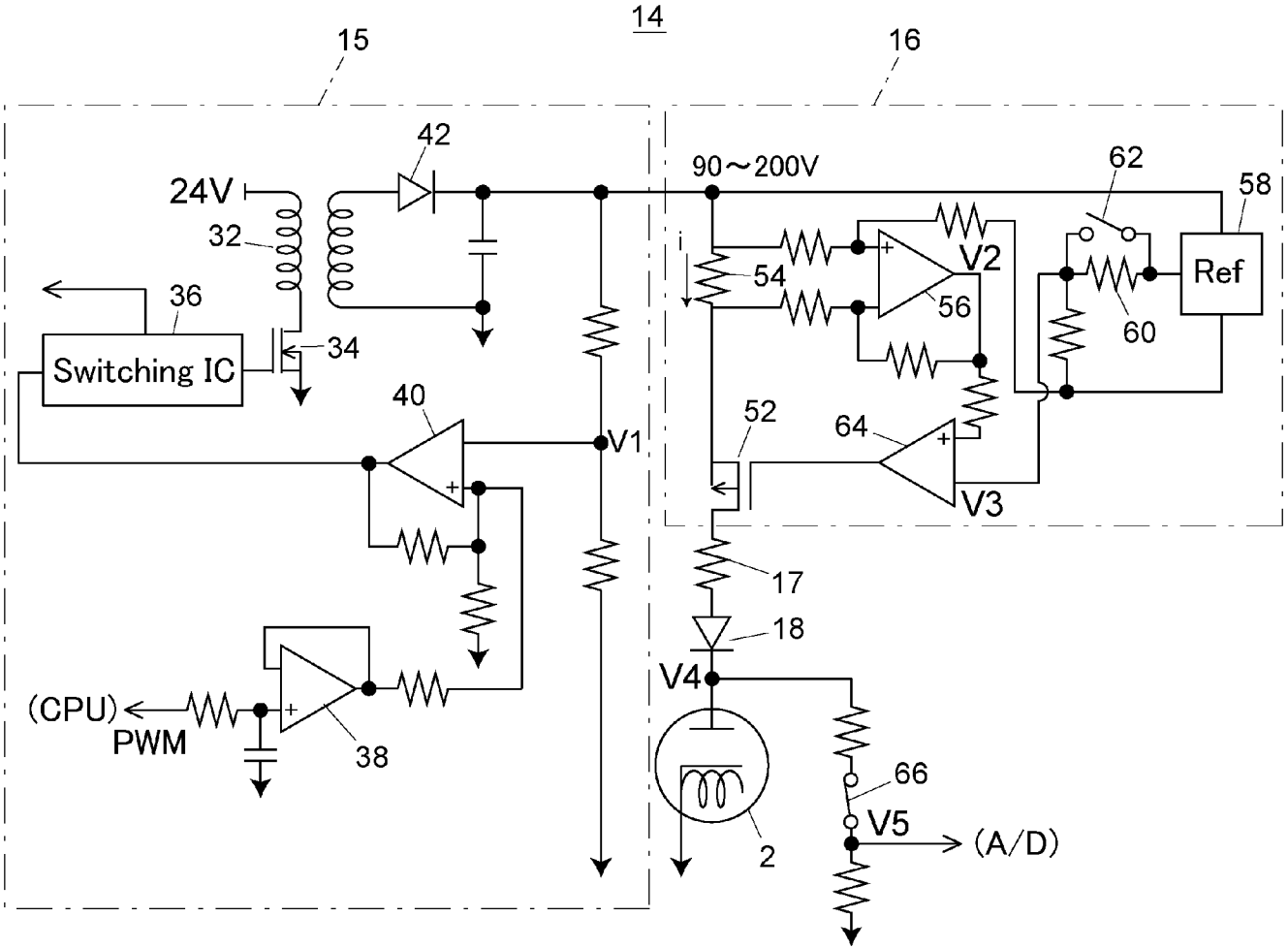
FIG. 2 is a circuit diagram specifically showing an example of the configuration of a gas discharge tube driving circuit of the light source apparatus of the embodiment.

In the lit deuterium lamp 2, electric discharge is maintained by the applied voltage regulated by the constant-current power source circuit 14 of the constant-current power source unit 5 and the selected constant current to maintain the light amount constant. As shown in FIG. 2, the constant-current power source circuit 14 can variably generate the voltage and the electric current, respectively.

An A/D converter 21 is connected to the anode of the deuterium lamp 2 to take in the voltage applied to the anode of the deuterium lamp 2, the taken-in anode voltage being provided for the applied voltage regulation by the constant-current power source circuit 14.

A lighting operation of the deuterium lamp 2 in this driving circuit, which includes a trigger voltage applying operation of the trigger power source unit 3, a voltage applying operation of the constant-current power source unit 5, and driving of the heater power source 4, is controlled by a power source controlling unit 20. The power source controlling unit 20 has source voltage controlling means 22 and a mode selection unit 26.

The source voltage controlling means 22 regulates the output voltage of the variable power source 15 in the constant-current power source circuit 14 of the constant-current power source unit 5 based on the voltage value taken in from the A/D converter 21. The source voltage controlling means 22 takes in the discharged voltage in the lit deuterium lamp 2 via the A/D converter 21, and controls the variable power source 15 so as to provide a voltage value obtained by adding a constant allowance to the voltage. For instance, when the measured value of the taken-in discharged voltage of the deuterium lamp 2 is 90 V, the variable power source 15 is controlled so that 110 V obtained by adding an allowance of e.g., 20 V to the voltage is a discharge maintaining voltage value.

The mode selection unit 26 sets the electric current value of the constant-current circuit 16 in the constant-current power source circuit 14 of the constant-current power source unit 5 after the deuterium lamp 2 is lit. In this embodiment, either a "normal mode" or an "energy saving mode" which saves the power consumption lower than the "normal mode" is selected in the mode selection unit 26. The "normal mode" is a mode which sets the flowing current of the lit deuterium lamp 2 to e.g., 300 mA, and the "energy saving mode" is a mode which sets the flowing current of the lit deuterium lamp 2 to e.g., 100 mA which is an electric current value lower than the electric current value of the "normal mode". The constant-current circuit 16 is provided with a mode changing switch which sets the flowing current of the deuterium lamp 2 at the time of setting the "normal mode" to "300 mA", and sets the flowing current of the deuterium lamp 2 at the time of setting the "energy saving mode" to "100 mA".

The mode selection unit 26 also includes a screen which is displayed on e.g., a monitor display device and allows an operator to select the mode. The mode selection unit 26 switches the mode changing switch of the constant-current circuit 16 so that the electric current value according to the mode selected on the monitor display device is the flowing current of the deuterium lamp 2.

In the "energy saving mode", the generated electric current of the constant-current power source unit 5 is lowered from 300 mA of the normal mode to 100 mA, so that the luminous amount of the deuterium lamp 2 becomes smaller, but the power consumption can be reduced to ⅓, and with it, the power loss can also be reduced to enable the heat release amount to be lower. On the other hand, since the luminous amount of the deuterium lamp 2 becomes smaller, the detected light intensity in the detection unit of the analyzer equipped with the deuterium lamp 2, such as a liquid chromatograph, becomes lower than the normal mode, with the result that it is feared that a signal-to-noise ratio of a detection signal is lowered, whereby the electric current value of the "energy saving mode" is set so as to provide the luminous amount which can obtain the signal-to-noise ratio to the extent that there is no trouble in measurement.

In the above case, the source voltage controlling means 22 feedback-controls the variable power source 15 so that the voltage applied to the deuterium lamp 2 is 200 V when the lighting of the deuterium lamp 2 is started and is a voltage obtained by adding 20 V to the voltage taken in by the A/D converter 21 after the deuterium lamp 2 is lit.

The power source controlling unit 20 can be realized by a controller of a spectrophotometer to which the deuterium lamp is attached, or a controller of a liquid chromatograph on which the spectrophotometer is mounted as a detector. Such controllers can be realized by a dedicated CPU (central processing unit) including a memory device or a general-purpose personal computer (PC) connected to the outside. In this embodiment, the description is made assuming that the power source controlling unit 20 is realized by the CPU as the controller of the spectrophotometer or the liquid chromatograph.

Next, FIG. 2 shows a specific example of the constant-current power source circuit 14 in FIG. 1 together with the deuterium lamp 2.

To supply a desired constant voltage, e.g., a constant voltage between 90 to 200 V, a flyback type switching power source circuit is provided as the variable power source 15. In the variable power source 15, a transistor 34 which is switched on and off at a predetermined frequency by a switching IC 36 is connected to a primary side of a transformer 32 which increases an input voltage of 24 V. A duty ratio of the transistor 34 is controlled so that an output voltage which appears on a secondary side of the transformer 32 is determined according to the duty ratio of the transistor 34 and the voltage rectified by a diode 42 is then the constant voltage between 90 to 200 V. To determine the output voltage, a divided voltage V1 of the output voltage of the transformer 32 and a voltage supplied from an operational amplifier 38 are supplied to and synthesized in an operational amplifier 40, and the synthesized voltage is then supplied to the switching IC 36. A pulse signal (PWM signal) set to a predetermined duty ratio is supplied from the CPU as the controlling unit 20 (FIG. 1) to the operational amplifier 38 and is then converted to the voltage supplied from the operational amplifier 38.

In the variable power source 15, the transistor 34 is switched to increase the input of 24 V by the transformer 32, but in that case, the synthesized voltage of the monitor voltage V1 and the PWM signal from the CPU is feedback-controlled to be the predetermined voltage of the switching IC 36. Therefore, the duty ratio of the PWM signal is appropriately set by the CPU, so that the variable supply of the constant voltage between 90 and 200 V is enabled. The voltage change range is not always limited to 90 to 200 V, and can also be a different voltage range.

The constant-current circuit 16 can make the flowing current of the lamp 2 at the discharge maintaining voltage after the trigger voltage is applied from the trigger circuit to light the lamp 2 constant, and can switch the flowing current amount between 300 mA in the normal mode and 100 mA in the energy saving mode. In the constant-current circuit 16, the voltage applied from the variable power source 15 is applied to the lamp 2 via a resistor 54, a transistor 52, the resistor 17, and the diode 18. In that case, the electric current value is regulated by the transistor 52. The transistor 52 is controlled by the output voltage of a comparator circuit 64.

A voltage obtained by amplifying the voltage drop of an electric current i flowing in the resistor 54 by a difference amplifier circuit 56 is applied to one input terminal of the comparator circuit 64, and a voltage V3 based on a reference voltage from a reference voltage circuit (Ref) 58 is applied to the other input terminal. The parallel circuit of a resistor 60 and a switch 62 is provided between the reference voltage circuit 58 and the other input terminal of the comparator circuit 64, the reference voltage is applied as the voltage V3 to the other input terminal of the comparator circuit 64 when the switch 62 is switched on, and a voltage obtained by lowering the reference voltage by the resistor 60 is applied as the voltage V3 to the other input terminal of the comparator circuit 64 when the switch 62 is switched off. The switch 62 is switched on and off according to the mode selection in the mode selection unit 26 of the power source controlling unit 20.

In this embodiment, when the trigger voltage is applied from the trigger circuit to light the lamp 2, the electric current i flows in the lamp 2. The resistors around the difference amplifier circuit 56 are set so that an output V2 of the difference amplifier circuit 56 is 3 V when the electric current i is 300 mA, and the output V2 of the difference amplifier circuit 56 is 1 V when the electric current i is 100 mA. In addition, the reference voltage circuit 58 and the resistor 60 are set so that the V3 is 3 V when the switch 62 is on, and the V3 is 1 V when the switch 62 is off.

Therefore, the constant-current circuit 16 becomes a constant-current circuit in which the transistor 52 is controlled so that the electric current i is 300 mA in the normal mode when the switch 62 is on and becomes a constant-current circuit in which the transistor 52 is controlled so that the electric current i is 100 mA in the energy saving mode when the switch 62 is off.

A contact at which a voltage value V5 obtained by resistance-dividing a voltage V4 is taken out so that the voltage V4 applied to the lamp 2 can be taken in the CPU as the power source controlling unit 20 is connected to the A/D converter 21, and the voltage value V5 is taken in the controlling unit 20 via the A/D converter 21. In FIG. 1, for simplification, the voltage division resistance on the input side of the A/D converter 21 is not shown. The voltage value V5 is obtained only by resistance-divides the voltage value V4, so that the voltage value V5 is handled like the voltage value V4 in the controlling unit 20 and will be described below as the voltage value V4.

The source voltage controlling means 22 of the power source controlling unit 20 feedback-controls the variable power source 15 by setting, as an operating voltage (V4+20 V) obtained by adding a predetermined voltage, e.g., 20 V to the voltage V4 taken in from the A/D converter 21 when lamp 2 is lit, by regulating the duty ratio of the pulse signal (PWM) supplied to the operational amplifier 38 of the variable power source 15 so that the voltage V4 taken in from the A/D converter 21 is the operating voltage.

The voltage value V4 may be monitored at all times while the lamp is lit, and may be monitored only for a fixed time immediately after the lamp is lit. The monitoring period can be set according to the opening and closing of a switch 66 provided in the circuit from the lamp 2 to the A/D converter 21.

Figure 3:
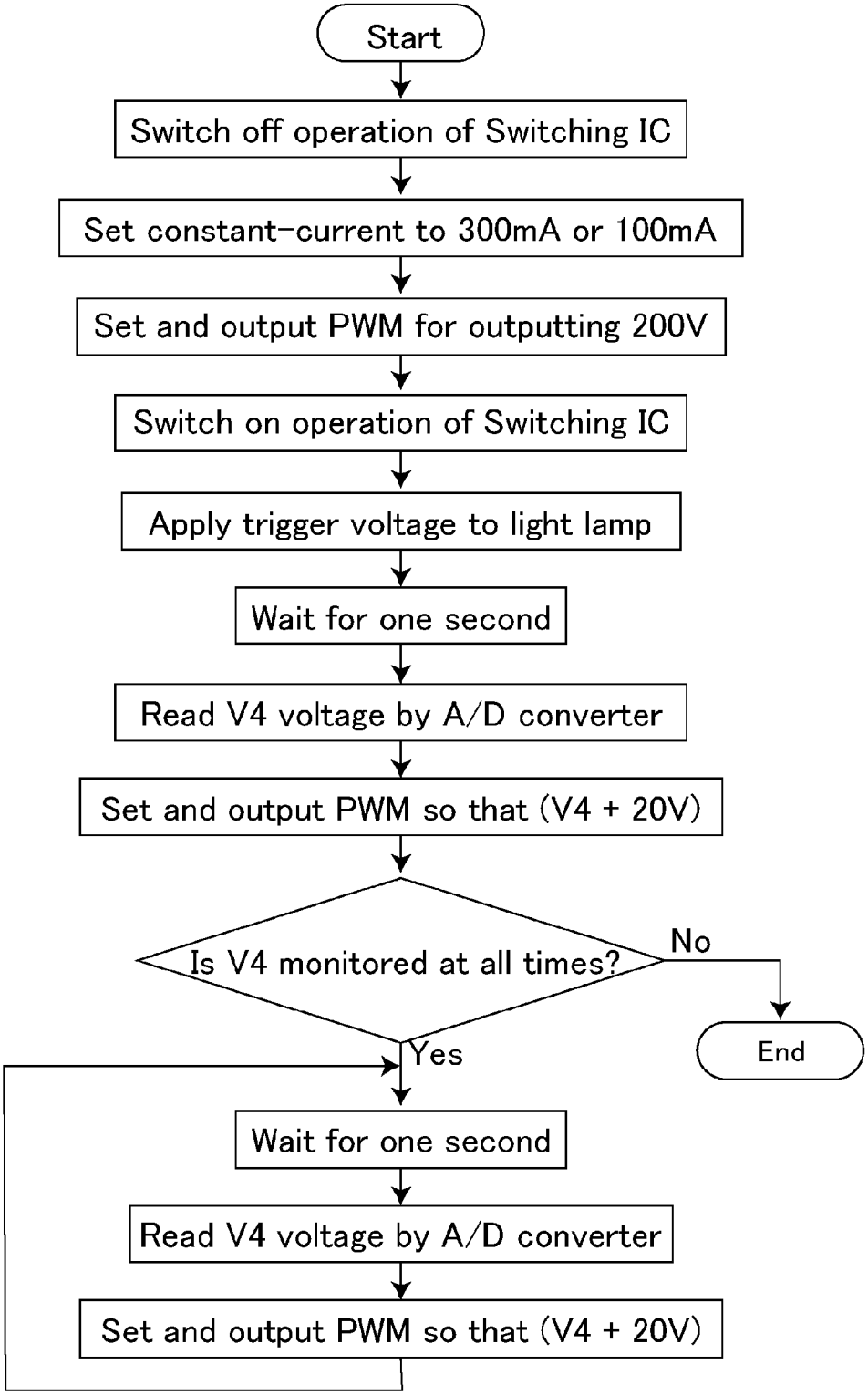
FIG. 3 is a flowchart showing the operation of the embodiment.
Figure 4:
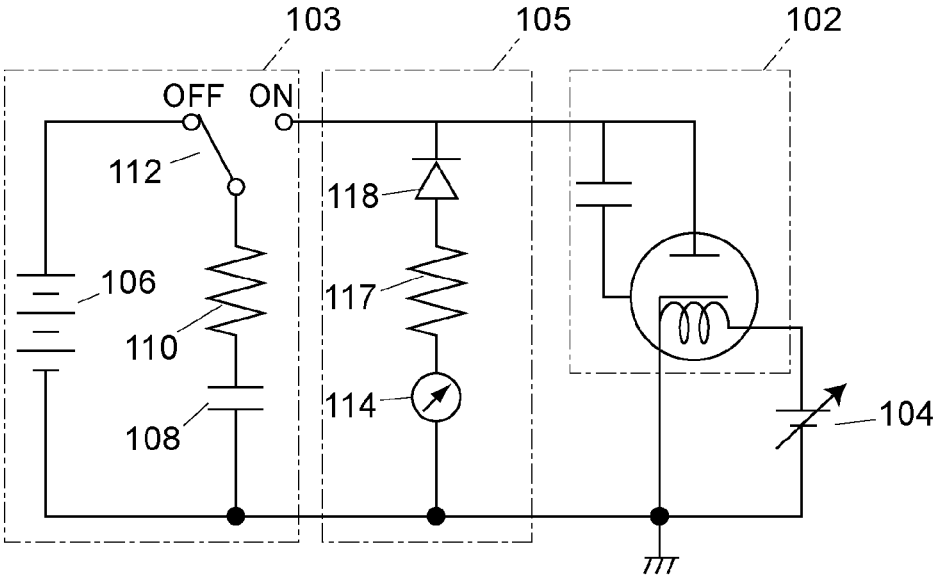
Fig. 4 Prior Art
FIG. 4 is a circuit diagram schematically showing an example of a conventional gas discharge tube driving circuit.

An example of the operation of the constant-current power source circuit 14 of this embodiment will be described with reference to the flowchart of FIG. 3.

The operation of the switching IC 36 is switched off. The constant-current control when the lamp is lit is set to either 300 mA or 100 mA. The switch 62 is switched on to set the constant-current control to 300 mA when the operator selects the normal mode, and the switch 62 is switched off to set the constant-current control to 100 mA when the energy saving mode is set.

The PWM is set and output so that the output voltage of the variable power source 15 is 200 V, the switching IC 36 is switched on, and the trigger voltage is applied to light the lamp 2.

Here, when the lamp 2 is not normally lit, the application of the trigger voltage to the lamp 2 is repeated a predetermined number of times, but when the lamp 2 is not still lit, an error may be notified to the operator.

After the lamp 2 is normally lit, e.g., the operational flow waits for one second. After one second elapses, the applied voltage V4 to the lamp 2 is read by the A/D converter to set and output the PWM so that the (V4+20V) is the operating voltage.

When the V4 is monitored at all times, the operation in which the PWM is set and output so that the (V4+20V) is the operating voltage, the operational flow waits for one second, the V4 is read, and the PWM is set and output so that (V4+20V) is repeated. When V4 is not monitored at all times, the PWM is set once for output so that ($V4_0$=V4+20V), thereby ending the routine.

Further, the waiting time from the lighting of the lamp 2 to the reading of the V4 by the A/D converter is not limited to one second.

The invention claimed is:

1. A light source apparatus comprising:

a gas discharge tube;

a trigger power source unit configured to apply a predetermined voltage so that the applied voltage to the gas discharge tube reaches a voltage at which electric discharge is started in the gas discharge tube when the gas discharge tube is lit;

a trigger switch for switching on and off the application of the voltage from the trigger power source unit to the gas discharge tube;

a constant-current power source unit connected to the gas discharge tube for applying a voltage to the gas discharge tube and performing the constant-current control of an electric current flowing in the gas discharge tube, the constant-current power source unit having a variable power source which is configured to adjust the voltage applied to the gas discharge tube;

a voltage detection unit for detecting the voltage applied to the gas discharge tube; and a power source controlling unit configured to control the voltage by adding a predetermined voltage to the voltage taken in from the voltage detection unit after the electric discharge is started in the gas discharge tube.

2. The light source apparatus according to claim 1, wherein the variable power source of the constant-current power source unit has a switching power source circuit, wherein a switching device of the switching power source circuit is controlled by a signal from the source voltage controlling means to adjust the output voltage of the variable power source.

3. The light source apparatus according to claim 2, wherein the constant-current power source unit has a constant-current circuit which is configured to select one of a plurality of electric current values flown to the gas discharge tube by a switching circuit, wherein the power source controlling unit has a mode selection unit for switching the switching circuit.

4. The light source apparatus according to claim 3, wherein the constant-current circuit has a transistor for adjusting the electric current value flown to the gas discharge tube by an output of a comparator circuit, wherein a voltage corresponding to the electric current value flown to the gas discharge tube is applied to one input terminal of the comparator circuit and a voltage from a reference voltage circuit is applied to the other input terminal of the comparator circuit, wherein the switching circuit is configured to switch the voltage applied from the reference voltage circuit to the other input terminal of the comparator circuit to a plurality of voltages.

5. The light source apparatus according to claim 1, wherein the constant-current power source unit has a constant-current circuit which is configured to select one of a plurality of electric current values flown to the gas discharge tube by a switching circuit, wherein the power source controlling unit has a mode selection unit for switching the switching circuit.

6. The light source apparatus according to claim 5, wherein the constant-current circuit has a transistor for adjusting the electric current value flown to the gas discharge tube by the output of a comparator circuit, wherein a voltage corresponding to the electric current value flown to the gas discharge tube is applied to one input terminal of the comparator circuit and a voltage from a reference voltage circuit is applied to the other input terminal of the comparator circuit, wherein the switching circuit is configured to switch the voltage applied from the reference voltage circuit to the other input terminal of the comparator circuit to a plurality of voltages.

* * * * *